United States Patent [19]

Kolb et al.

[11] 4,070,163

[45] Jan. 24, 1978

[54] METHOD AND APPARATUS FOR ELECTROSTATIC PRECIPITATING PARTICLES FROM A GASEOUS EFFLUENT

[75] Inventors: Alan C. Kolb, Solana Beach; James E. Drummond, Coronado, both of Calif.

[73] Assignee: Maxwell Laboratories, Inc., San Diego, Calif.

[21] Appl. No.: 603,157

[22] Filed: Aug. 8, 1975

Related U.S. Application Data

[63] Continuation-in-part of Ser. No. 502,103, Aug. 29, 1974, abandoned.

[51] Int. Cl.[2] ..... B03C 1/00

[52] U.S. Cl. ..... 55/11; 55/150

[58] Field of Search ..... 55/2, 5, 11, 101, 102, 55/107, 134, 135, 136–138, 146, 148, 150, 154, 155; 118/49.1, 49.5; 317/4; 250/423, 424, 425; 427/13; 204/164, 290 R, 290 E

[56] References Cited

U.S. PATENT DOCUMENTS

| | | | |
|---|---|---|---|
| 1,343,285 | 6/1920 | Schmidt | 55/2 |
| 1,409,901 | 3/1922 | Anderson | 55/2 |
| 2,524,227 | 10/1950 | Klein | 55/150 |
| 2,594,777 | 4/1952 | Hicks | 317/4 |
| 3,740,925 | 6/1973 | Gothard | 55/5 |

FOREIGN PATENT DOCUMENTS

| | | | |
|---|---|---|---|
| 155,683 | 3/1954 | Australia | 55/146 |
| 1,046,652 | 10/1966 | United Kingdom | 55/101 |

*Primary Examiner*—Bernard Nozick
*Attorney, Agent, or Firm*—Fitch, Even, Tabin & Luedeka

[57] ABSTRACT

Apparatus and a method for electrically sweeping particles from a gaseous effluent are disclosed which offer improved efficiency in removing particles of all sizes. A voltage is applied across two electrodes in such a way that a strong electric field can be generated between them. Ions of one sign enter the effluent gas stream from a thermionic ion emitter. A strong electric field is established between the electrodes to move the ions towards the oppositely charged electrode. These ions of one sign rapidly charge the particles because of the strong electric field. The charged particles are moved by the field and deposited on the oppositely charged collection electrode where they agglomerate in preparation for collection and disposal.

18 Claims, 2 Drawing Figures

Figure 1:
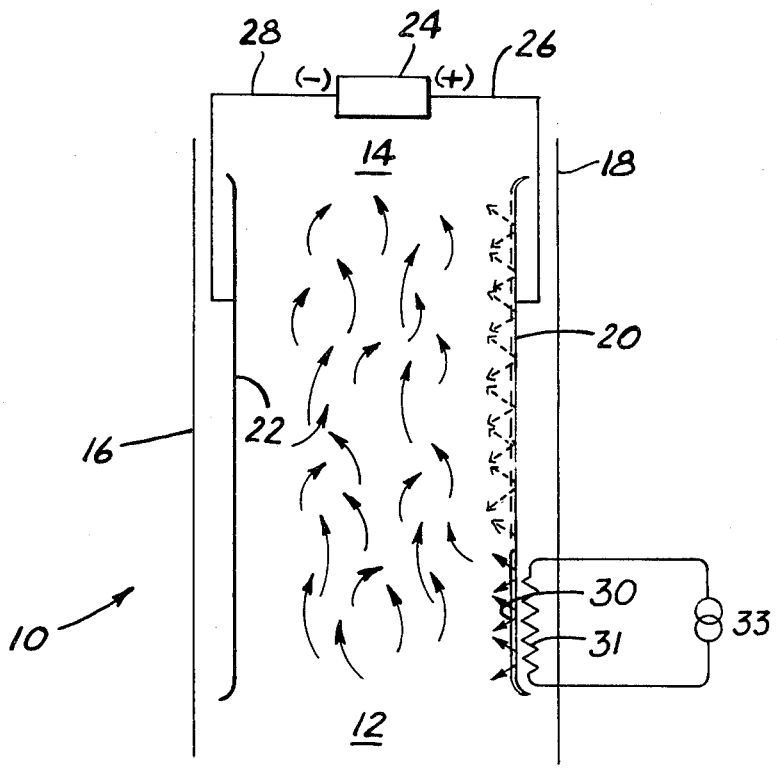

METHOD AND APPARATUS FOR ELECTROSTATIC PRECIPITATING PARTICLES FROM A GASEOUS EFFLUENT

This is a continuation-in-part of our original application, Ser. No. 502,103, filed Aug. 29, 1974 now abandoned.

The present invention generally relates to electrostatic precipitators and, more specifically, to a method and apparatus which is particularly effective for rapidly precipitating particles of several microns diameter from a hot gaseous medium and which is also capable of precipitating sub-micron diameter particles.

As industry converts from oil to coal for electric power production by high efficiency gas turbogenerators, turbine lifetime is seriously reduced by erosion caused by the increased concentration of large size (1–10 microns) flyash in the hot gases entering these machines. Other important cases exit in industry such as cleaning the effluent from basic oxygen furnaces and from municipal incinerators where there is need for precipitators which will operate well at high temperatures. Above 300° C, fabric filters are unsuitable because of limitations of the fabric material. Aqueous scrubbers are not possible above the critical temperature of water, 374° C, and other liquids are too costly to be practical. At high temperature and pressure, the increased viscosity of gas reduces the effectiveness of electrostatic precipitators. High temperature alone can make it difficult to maintain a stable corona discharge.

Moderate temperature gas exhausted to the atmosphere must be well cleaned of particles in the range of 0.1 to 5 microns diameter which are of the greatest health hazard.[2] The best current industrial gas cleaning equipment, whether filter[3], scrubber[3], or electrostatic precipitator[4] is least effective in removing particles between 0.1 and 1 microns diameter which remain suspended longest in the air.

[1]National Bureau of Standards Technical News Bulletin, dated December 1972.

[2]R. G. Dorman, "Filtration", Ch. VIII in "Aerosol Science", ed. by C. N. Davis, Academic Press (1966), p. 211–213.

[3]R. E. Harrington, "Fine Particulates — The Misunderstood Air Pollutant", Proc. of EPA-APT Fine Particle Scrubber Symposium, May 1974.

[4]Myron Robinson, "Electrostatic Precipitation", Sec. IV in "Air Pollution Control" ed. by Werner Strauss, Wiley Interscience, p. 264 (1971).

All electrostatic precipitators use two charging mechanisms to build up the charge on a dust particle. These two mechanisms are diffusion charging and field charging. In field charging, ions are accelerated by the electric field of the precipitator. These accelerated ions strike a dust particle and combine with it. As the dust particle accumulates these charges, it takes on the same charge as the ions. When the dust particle becomes charged and has the same charge as the ion, the ion and charged particle tend to repel each other, which makes it more difficult for other ions to add additional charges to the particle. For a given electric field strength and a given size of dust particle, there will be a limit beyond which the dust particle will no longer accept additional charges by field charging. For small particles in conventional precipitators, this limit is very quickly reached. The other charging mechanism, diffusion charging, utilizes thermally activated ions that possess sufficient energy to penetrate the repelling field and add additional charges to the dust particle. This charging mechanism will charge small particles, but is quite slow compared to the mechanism of field charging.

It is generally known that presently used industrial precipitators are relatively ineffective in removing particles having a size range of about 0.1 to about 1 micron. Conventional electrostatic precipitators fail to collect these fine particles as rapidly as the larger particles because the diffusion mechanism is the mechanism that is used to deposit electric charge on the small particles and it operates too slowly for such particles. Ions drift onto the particles by thermal motion so that as a particle begins to acquire a charge, it repels the slower moving ions which could bring further charges to the particle. Stated in other words, large particles are predominately charged by the charging mechanism of field charging which is subject to a limit based upon the electrostatic repulsion of the charged particle against further charges approaching it. Those charges are typically driven by an electric field applied by remote electrodes. Thus, in the prior art apparatus and in the present invention the balance between the driving and repelling forces determines the maximum charge which can be acquired, $N_s$:

$$N_s = 52\,\epsilon\, ED^2/\epsilon + 2$$

where $N_s$ is the saturation number of electronic magnitude charges, $E$ is the applied electric field in kilovolts per centimeter, $D$ is the particle diameter in microns and $\epsilon$ is the particle dielectric constant. However, in conventional electrostatic precipitators used in moderate temperature applications, the mean charging and collection field is limited to about 4 kV/cm because it is linked to a higher field which supports a corona discharge adjacent a small, field enhancing electrode and higher fields tend to cause spark breakdown in the gas.

In conventional electrostatic precipitators, the only effective charging method for charging small particles is by diffusion charging because of the low electric field. The number of charges added is given approximately by the following equation:

$$N = 0.03\, T\, D\, \ln\,(1 + 0.0042\, N_o\, D\, t/T^{1/2}\, M^{1/2})$$

where $T$ is ion kinetic temperature in degrees Kelvin, $N_o$ is the ambient concentration of ions/cm$^3$ and $t$ is the time in seconds after the field charging has been completed and $M$ is the molecular weight of the ions. Since the charge attained after a long time by diffusion is proportional to $D\ \ln D$, it will exceed the field produced charge for small particles. In prior art precipitators, for example, ion densities are typically $3 \times 10^7$/cm$^3$ with $M \approx 30$. At this ion density, about 0.3 second is required to deposit about 20 charges on a 0.3 micron diameter particle by diffusion at 270° C, one atmosphere pressure while 24 seconds would be required to double this charge and the transit time of gas through typical precipitators is only about 8 seconds.

In other words, conventional electrostatic precipitators operate by producing ions of both polarities in a corona discharge plasma near one small electrode around which the electric field concentrates. The strength of the field is quite high near the electrode and drops dramatically away from the electrode and thereby provides a nonuniform field. Ions of one polarity are withdrawn from this region and as they drift toward the other electrode, they become attached to the aerosol particles in the effluent. To produce the field enhancement necessary for corna discharge at one electrode without causing electrical breakdown between the two electrodes, conventional precipitators often make use of coaxial geometry with a small diameter wire as the center electrode and a large diameter outer cylinder. The drift of the ions is caused by the interaction of the charge on the ion and the nonuniform, generally weak electric field. As the ions drift, they charge the particles by attaching to them, thereby causing the particles to be driven by the electric field toward and attached to the collecting electrode.

The efficiency of all electrostatic precipitators including those of the prior art and also of the present invention is limited by three major factors. The first arises because the charging rate of the aerosol particles decreases rapidly as the radius of the particles decreases. Thus, as the size of the particles decreases, the particle charge is less and the drift velocity, i.e., the component of the average velocity of the particles directed toward the electrodes, decreases. The second factor is that for a given charge the drift velocity decreases as the electric field strength decreases. Thus, the drift velocity of a given size particle decreses as it moves in the direction toward the collecting electrode because of the decreasing field in the coaxial electrode configuration. The third factor is the attachment efficiency of the collector electrode, i.e., the particles which are drifted to the collector electrode may rebound or be dislodged by the impact of other particles or be swept away by the turbulent flow of the gaseous effluent after they have been initially collected upon it because the charge on the particles and the electric field they experience are not sufficiently large.

It has generally been recognized that improved operation of an electrostatic precipitator results from increasing the electric field strength provided, however, that electrical breakdown or arcing does not result from the higher electric field strength. The prior art discloses precipitating apparatus which independently produces the ions and the electric field rather than a configuration that uses a small wire central electrode and outer cylindrical electrode to simultaneously create the ions and the electric field. While radioactive materials and photoionization sources, e.g. light tubes such as ultraviolet lamps, have been disclosed to provide a source of ions independently of the production of the electric field, these ion sources have practical operational and other disadvantages and it is not believed that any commercial apparatus has been developed. A disadvantage of radioactive sources is the difficulty in varying the energy and quantity of particles emitted by such sources. Further, the psychological impact of using a radioactive source of ions in a precipitating apparatus, particularly in an urban area, would be quite negative. Moreover, there could be a significant problem of radiactive contamination of the atmosphere if a rupture or breakdown of some portion of the apparatus occurred. Precipitators that use ultraviolet or other lamps to provide photons for creating the necessary ionization within the precipitator are also subject to many practical operational disadvantages. The lamps are subject to dusting or clouding over by the particles in the gaseous medium or effluent and wil become dirty quite rapidly. This dusting over easily occur in only a few seconds and greatly decreases the efficiency of their operation.

However, the present invention does not suffer from the disadvantages of these radioactive and photoionization sources and, in fact, exhibits many desirable attributes that enables it to achieve the results sought by the above sources in addition to other significant advantages.

More particularly, the present invention utilizes a thermionic ion emitter to bombard the gaseous medium within the precipitator with ions of one sign. The thermionic ion emitter has the advantage of being able to emit ions of one sign into the gaseous medium and the ions can charge particles throughout the volume within the precipitator, i.e., there is no region of ambipolar plasma. Moreover, lower capital and operating costs, as well as lower maintenance costs may be expected in certain applications. If the positive electrode is provided with the thermionic ion emitter material, it is self cleaning and will not dust up or become dirty from the particles within the gaseous medium or effluent. These and other advantages will be described in detail hereinafter.

Accordingly, it is an object of the present invention to provide an improved method and apparatus for precipitating particles from a gaseous medium such as a gaseous effluent, which method and apparatus are effective to rapidly remove small particles, i.e., those particles between about 0.1 and 10 microns in diameter even when the gas is at high temperature and/or high pressure.

Yet another object of the present invention is to provide an improved method and apparatus for removing particles from gaseous effluents with high volume throughput, high efficiency, and only moderate power requirements especially when the effluent gas is at high temperature.

Figure 2:
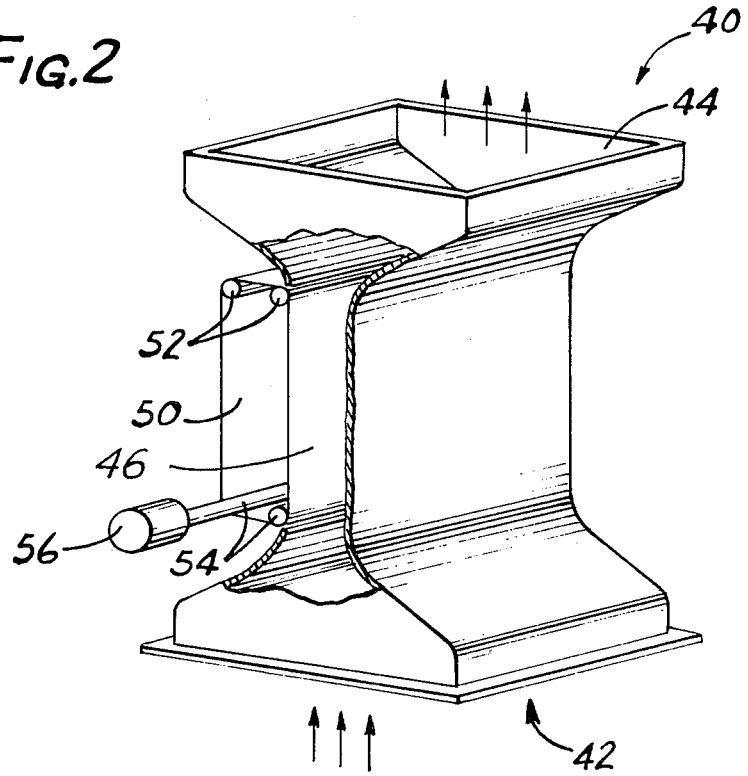

Other objects and advantages of the present invention will become apparent upon reading the following detailed description, in conjunction with the attached drawings, in which:

FIG. 1 is a diagrammatic representation of precipitating apparatus embodying the present invention and which is useful for practicing the method of the present invention; and, FIG. 2 is a perspective view of one form of the apparatus that may be used to practice the method of the present invention.

Broadly stated, the present invention is directed to apparatus as well as a method for precipitating or removing particles from a stream of gaseous effluent which preferably uses a generally uniform, strong electric field for charging the particles with ions, with the ions being supplied independly of the source of the electric field from a thermionic ion emitter. A precipitating station includes at least one positively and one negatively charged electrode for setting up the electric field, and the source of ions which charge the particles. The particles charged in the presence of the electric field are thereby precipitated out and removed from the gaseous effluent and collected at one of the electrodes. The thermionic ion emitter produces ions of one sign in the gaseous medium or effluent, preferably near the electrode having a charge of the same sign. Once the particles are within the region between the charged electrodes, they will acquire a net charge from the ions emanating from the ion emitter and will be attracted to the oppositely charged collection electrode.

Referring to the drawings and particularly FIG. 1, an idealized schematic cross-sectional diagram of apparatus which may be used to carry out the method of the present invention is shown. The apparatus, indicated generally at 10, communicates a gaseous medium or effluent from the lower inlet 12 through to the outlet 14 in an upward direction as shown. Side walls 16 and 18 direct the flow of the gaseous medium through the apparatus. A positively charged electrode or anode 20 is located adjacent the side wall 18 in the gaseous medium and a negatively charged electrode 22 is positioned adjacent the side wall 16 so that an electric field is set up between the anode and the cathode across substantially the entire channel width as shown. The anode 20 and cathode 22 are charged by a direct current source 24 having its positive terminal connected to the anode 20 through line 26 and its negative terminal connected to the cathode 22 through line 28. As is depicted by the arrows within the channel or area inside between the inlet and outlet of the apparatus, the gaseous medium carrying the particles flows upwardly through the apparatus between the electrodes 20 and 22. The electrodes 20 and 22 are preferably generally flat, planar members having arcuate edges that are charged by the external source 24 to positive and negative potentials, respectively. The generally flat configurations and curved edges of the cathode and anode are preferred to minimize electric maxima, i.e., it is desirable that the average field strength approach the maximum field strength within the apparatus. Stated in other words, it is desirable that the electric field be uniform so that it can be maximized without experiencing electrical breakdown or arcing. A layer 30 of thermionic ion emitter material is preferably applied to the front surface of the anode 20, although it may be positioned elsewhere in the apparatus so long as the ions emitted may flow into the gaseous medium or effluent that passes through the apparatus. For optimum efficiency, it is necessary that the thermionic ion emitter provide a sufficient quantity of ions to adequately charge all the particles that pass through the apparatus. This may be accomplished by the layer 30 covering all or only a portion of the anode 20 as shown in FIG. 1, the extent required depending upon the effluent gas flow speed and the size and resistively of the particles being precipitated.

It is preferred that the anode 20 have the layer 30 of thermionic ion emitter material on its surface because it will not become caked or coated with dust particles and can thereby be considered to be self cleaning. Particles will not coat the layer 30 because the positive ions that are emitted from the layer will positively charge the particles approaching the layer and the positively charged anode will repel the positively charged particles.

The themionic ion emitter material is preferably operable to produce ions at the prevailing temperature of the gaseous medium or efffluent which passes through the precipitator. Such as application requires little or no operating energy for the production of the ions. However, if the temperature of the gaseous medium is not sufficiently high to produce emission, the material can be heated to the necessary operating temperature as shown, for example, by the heater 31 which connects with a power source 33. The thermionic ion emitter material can be produced which will provide a sufficient quantity of ions to operate effectively within a temperature range of about 650° C to about 1500° C.

The layer 30 of thermionic ion emitter material may consist of the beta phase of eucryptite ($Li_2O$ . $Al_2O_3$ . $2SiO_2$) which emits Lithium ions ($Li^+$) at about 40 microamperes per square foot when it is heated to a temperature of about 800° C. As is well known by a person skilled in the art, various other thermionic ion emitter materials may be used in place of eucryptite for purposes of this invention; for example, other alkali metals may be used to replace lithium in the eucryptite formula given above; also one may use spodumene-like material such as $X_2O$ . $Al_2O$ . 4 $SiO_2$ where X is the metal in question.

The use of the thermionic ion emitter as the source of ions has an advantage in that it can be easily bonded to a surface and does not represent a substantial capital expenditure. Thermionic ion emitters like $\beta$-eucrypitite operate at such low temperatures that virtually no electrons are emitted. Hence, there is no plasma region containing nearly equal concentrations of oppositely charged ions (like that near a corona wire or that produced by photoionization) which can nearly neutralize a charged dust particle entering it and limit net charging of an initially neutral particle remaining in it. With the thermionic ion source, particle charging takes place over the entire region between the ion emitter and the collector electrode which means that turbulence or large scale mixing is not required to accomplish charging of the particles in neutral regions.

The upper electric field strength limit is determined by the dielectric strength of the gaseous medium at operating pressure. For a 10 centimeter separation distance between cathode and anode, the uniform field breakdown strength of air at normal density is about 26 kV/cm.

The lithium ions, for example, charge the particles very rapidly because they are about 10 times lighter than ions of the effluent gas which are employed to charge the particles in prior art precipitators. These ions are also driven onto the particles by a much larger average electric field than is available in prior art precipitators. The particles as they become charged are given more rapidly toward the collecting electrode by this larger electric field. The particles may acquire additional charges by impingement of ions while they are attached to the cathode. This would increase the holding force so that they would not be inclined to be dislodged. However, if the dust is of very high resistivity, excessive local field strength can result from this charge buildup and cause harmful local breakdown within the dust layer producing ions of both signs and possibly also re-entrainment. This local breakdown can be prevented by keeping the ion density in the collection region low downstream of the region of initial particle charging. Particles of all sizes rapidly collect on the cathode 22 because the electric field, no longer limited to about 4 kV/cm in the bulk of the gaseous medium (at $\approx$270° C and atmospheric pressure) by the requirement of corona generation at a thin electrode, can be raised to between 13 and about 18 kV/cm. In the preferred form of operation, the high field covers virtually all the distance between the electrodes. As previously mentioned, the saturation charge by the usual mechanism of field charging is subject to a limit caused by the electrostatic repulsion between the particles that have acquired a charge and additional charges which approach it.

In accordance with the present invention, however, the saturation charge on all particles is much greater because the mean electric field strength can be raised by about a factor of between about 3 and 5. Thus, a maximum of between about 60 and 80 charges would be deposited on a 0.3 micron particle in an 18 kV/cm field, while only about 20 to 30 charges are typically deposited during the transit of such a particle through an ordinary electrostatic precipitator. With respect to field charging, the initial charging rate is given by $$dN/dt = \frac{1.2 \times 10^{-5} E N_o \epsilon D^2}{\epsilon + 2} \mu$$

where $D$ is the particle diameter in microns, $E$ is the field strength in kilovolts per centimeter, $\epsilon$ is the dielectric constant of the particle, $\mu$ is the ion mobility in $cm^2$/volt sec., and $N_o$ is the ambient ion concentration in number per cubic centimeter. Values for $N_o$ are about $3 \times 10^7$ per cubic centimeter and $\mu \approx 4$ $cm^2$/volt sec. at 270° C in conventional precipitators. In the present invention, lithium ions have $\mu \approx 8$ $cm^2$/volt sec. so $N_o$, which can be controlled independently of the field strength E can be reduced by the same factor by which $E\ \mu$ is increased without reducing the field charging rate. Thus, the resistivity of the charging region can be increased by a factor of 3 to 5. This means that the point at which back corona starts can be raised to dust resistivities 3 to 5 times greater.

For $\epsilon \approx 1$, diffusion charging dominates. In an ordinary precipitator 0.3 seconds are required for a 0.3 micron particle to acquire 20 charges by diffusion. In the present invention, this would take place in less than 0.1 second. In the usual precipitator, about 24 seconds would be required for diffusion charging to about 45 charges; in the present precipitator, the lighter lithium ions produce charging in about 8 seconds.

From the above, it should be understood that a large decrease in charging time as well as a large increase in total charge occurs for a 0.3 micron diameter particle being charged in the large electric fields that can exits in a channel where ions are supplied by the agency of the thermionic ion emitter rather than in the smaller overall fields typical of a conventional precipitator.

Turning now to FIG. 2 which illustrates one form of apparatus that is useful in practicing the method of the present invention, the appartus 40 has an inlet 42 at its lower end and an outlet 44 at its upper end, with gaseous medium or effluent flowing vertically upwardly as shown by the arrows. The dust laden gaseous effluent preferably flows in the precipitation channel at 5 to 10 meters per second. A thermionic ion emitter material is positioned within the apparatus to irradiate the gaseous effluent with ions while it is within the channel 46. A cathode is provided and may be in the form of a flexible stainless stell belt 50 as shown which travels around upper and lower rollers 52 and 54, respectively, with one of the lower rollers being driven by a motor 56. The belt has a front side exposed to the gaseous medium or effluent containing high resistivity dust passing through the channel and a back side that is outside of the channel enabling the particles to be removed from the belt before the belt reenters the channel and again becomes exposed to the effluent. One advantage of the apparatus shown in FIG. 2 is that it is of a relatively small height compared with less effective prior art precipitators for a given throughput rate.

From the foregoing detailed description, it should be understood that a method and apparatus for electrostatically precipitating particles from a particle carrying gaseous medium has been illustrated and described which is more efficient than conventional designs and is effective in removing small particles, even to submicron sizes. In addition to effectively precipitating such small particles, the present invention provides rapid charging and rapid precipitation of larger particles, as well and enables fast throughput of the gaseous medium or effluent.

Although particular embodiments of the present invention have been illustrated and described, various modifications, substitutions and alternatives will be apparent to those skilled in the art, and, accordingly, the scope of the invention should be only defined by the appended claims and equivalents thereof.

Various features of the invention are set forth in the following claims.

What is claimed is:

1. A method of electrostatically precipitating particles from a gaseous medium carrying the same, comprising:

passing the medium through a channel in an electrostatic precipitating station wherein said particles are brought into a region containing ions of only one sign, said region including substantially the entire volume in said channel between an ion emitter and a collection electrode;

generating said supply of ions of one sign in said region by thermionic ion emission from a thermionic ion emitter material comprising the beta phase of $Li_2O$ . $Al_2O_3$ . 2 $SiO_2$ heated to a temperature sufficient to cause ion emission;

subjecting said medium to a generally uniform, strong electric field to drive said ions of one sign onto said particles;

said electric field causing attraction of said charged particles to one or more electrodes having a charge of opposite polarity to thereby precipitate said particles out of the medium.

2. A method as defined in claim 1 wherein said temperature is about 800° C.

3. A method as defined in claim 1 wherein said ions are generated only in the upstream portion of said precipitating channel.

4. A method as defined in claim 1 wherein said ions are generated throughout the length of said precipitating channel.

5. A method as defined in claim 1 wherein said ion emitter is heated from an external source.

6. A method as defined in claim 1 wherein said ion emitter is heated by the hot gaseous medium.

7. A method for electrostatically precipitating particles from a gaseous medium carrying the same, comprising the steps of:

passing the medium through a precipitating station having a plurality of electrodes including at least one positively charged electrode and at least one negatively charged electrode, selective electrodes being charged to produce a strong electric field within said precipitating station;

subjecting said medium within said precipitating station to a supply of positive ions produced by a thermionic ion emitting material comprising the beta phase of $Li_2O$ . $Al_2O_3$ . 2 $SiO_2$ heated to a temperature sufficient to produce said supply of ions;

said ions charging the particles in said medium so that the magnitude of the attractive force between the particles and said negative electrode increases sufficiently so that the charged particles move toward said negatively charged electrode.

8. A method as defined in claim 7, wherein said material is applied to said positively charged electrode.

9. A method for removing particles from a gaseous medium at a precipitating station having a plurality of electrodes including at least one anode and at least one cathode, the cathode being adapted to attract particles having a net positive charge, comprising the steps of:

charging said electrodes to produce a strong electric field within said precipitating station;

passing the particle containing medium through the electrostatic precipitating station;

subjecting the medium to ions of one sign produced by a thermionic ion emitter located within the precipitating station, said thermionic ion emitter comprising the beta phase of $Li_2O \cdot Al_2O_3 \cdot 2\ SiO_2$ heated to a temperature sufficient to cause ion emission, the ions charging said particles in said medium so that said electric field causes said charged particles to be attracted to an oppositely charged electrode.

10. A method as defined in claim 9 wherein said electric field is up to the range of about 12 kV/cm to about 18 kV/cm.

11. A method as defined in claim 9 wherein said electrodes comprise generally flat members having arcuate edge portions.

12. A method as defined in claim 9 wherein said thermionic ion emitter produces positive ions and is applied to at least one of said positive electrodes.

13. A method as defined in claim 9 wherein said temperature is about 800° C.

14. Apparatus for removing particles from a gaseous medium passing therethrough, comprising:

an inlet for receiving and an outlet for expelling the medium;

a central portion between said inlet and outlet for guiding said medium through the apparatus;

at least one positivity charged electrode located in said central portion;

at least one negatively charged electrode located in said central portion for attracting particles having a net positive charge from the medium;

thermionic ion emitter means comprising the beta phase of $Li_2O \cdot Al_2O_3 \cdot 2\ SiO_2$ heated to a temperature sufficient to cause ion emission for producing a supply of positive ions which bombard particles and cause them to be attracted to said negatively charged electrode.

15. Apparatus as defined in claim 14 wherein said temperature is about 800° C.

16. Apparatus as defined in claim 14 wherein said positively charged electrode has a layer of said thermionic ion emitter material applied thereto.

17. Apparatus as defined in claim 14 wherein said positive ion producing means produces said supply of ions adjacent said positively charged electrode.

18. Apparatus as defined in claim 14 wherein said electrodes are in the form of generally flat members having curved edge portions.

* * * * *

UNITED STATES PATENT AND TRADEMARK OFFICE

CERTIFICATE OF CORRECTION

PATENT NO. : 4,070,163

DATED : January 24, 1978

INVENTOR(S) : Alan C. Kolb and James E. Drummond

It is certified that error appears in the above-identified patent and that said Letters Patent are hereby corrected as shown below:

| | |
|---|---|
| Col. 1, line 35 | "hazard$^2$" should be --hazard$^1$". |
| Col. 1, line 36 | "filter$^3$" should be --filter$^2$--. |
| Col. 3, line 60 | "wil" should be --will--. |
| Col. 3, line 61 | Insert "may" after "over". |
| Col. 4, line 46 | "independly" should be --independently--. |
| Col. 5, line 51 | "as" should be --an--. |
| Col. 6, line 35 | "given" should be --driven--. |

Signed and Sealed this

*Twenty-fifth* Day of *July 1978*

[SEAL]

*Attest:*

RUTH C. MASON
*Attesting Officer*

DONALD W. BANNER
*Commissioner of Patents and Trademarks*